US008899589B2

(12) United States Patent
Kueng

(10) Patent No.: US 8,899,589 B2
(45) Date of Patent: Dec. 2, 2014

(54) ASYMMETRIC PADDLEBALL TOY WITH PLAY-DIRECTION SWITCHING SLOT

(71) Applicant: Active People, Limited, Fortress Hill (HK)

(72) Inventor: Rene Isidor Kueng, Binningen (CH)

(73) Assignee: Active People Limited, Fortress Hill (HK)

( * ) Notice: Subject to any disclaimer, the term of this patent is extended or adjusted under 35 U.S.C. 154(b) by 0 days.

(21) Appl. No.: 13/998,920

(22) Filed: Dec. 23, 2013

(65) Prior Publication Data

US 2014/0183821 A1 Jul. 3, 2014

Related U.S. Application Data

(60) Provisional application No. 61/806,942, filed on Apr. 1, 2013, provisional application No. 61/745,602, filed on Dec. 23, 2012.

(30) Foreign Application Priority Data

Jul. 23, 2013 (GB) ..... 1313130.5

(51) Int. Cl.
*A63B 67/10* (2006.01)
*A63B 67/20* (2006.01)
*A63B 67/22* (2006.01)

(52) U.S. Cl.
CPC ..... *A63B 67/20* (2013.01)
USPC ..... 273/330; 273/331; 273/335; 473/423; 473/424; 473/425

(58) Field of Classification Search
USPC ..... 273/329, 330, 331, 335; 473/423, 424, 473/425; D21/466
See application file for complete search history.

(56) References Cited

U.S. PATENT DOCUMENTS

| | | | | | |
|---|---|---|---|---|---|
| 1,282,016 | A | * | 10/1918 | Hudson | 273/330 |
| 1,411,451 | A | * | 4/1922 | Mygind | 473/576 |
| 2,142,068 | A | * | 12/1938 | Berger | 273/330 |
| 2,208,086 | A | * | 7/1940 | Singer | 273/330 |
| 2,967,711 | A | * | 1/1961 | Anderson | 273/329 |
| 3,148,883 | A | * | 9/1964 | Ruderian | 273/330 |
| 3,157,400 | A | * | 11/1964 | Schmid | 273/330 |
| 3,737,164 | A | * | 6/1973 | De Yoe, Jr. | 273/329 |
| 4,040,623 | A | * | 8/1977 | Ott | 273/329 |
| 4,300,771 | A | * | 11/1981 | Lori | 273/329 |
| 5,288,083 | A | * | 2/1994 | Palmieri | 273/329 |
| D445,147 | S | * | 7/2001 | Saldana | D21/466 |
| 7,909,329 | B1 | * | 3/2011 | Martinson | 273/330 |

* cited by examiner

*Primary Examiner* — Raleigh W Chiu
(74) *Attorney, Agent, or Firm* — McCormick, Paulding & Huber LLP

(57) ABSTRACT

A paddleball toy having a paddle, a bounceable play ball, and an elastic tethering means. The paddle has an impact surface and an elongate handle with a handle longitudinal axis. The paddle has a front side and a back side. The handle connects to the impact surface at a lower end of the impact surface. The impact surface has a direction-switch slot extending from a slot bottom at an interior point of the impact surface to an exterior edge of the impact surface. The elastic tethering means tethers the play ball at a first end of the tethering means to a tether spot on the impact surface adjacent the slot bottom of the direction-switch slot so as to permit the tethering means to pass through the direction-switch slot as the play ball passes the impact surface from front side to back side, or back side to front side.

20 Claims, 6 Drawing Sheets

FIG. 12
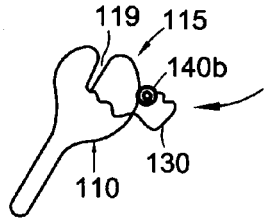
FIG. 13
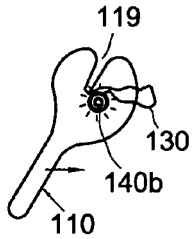
FIG. 14
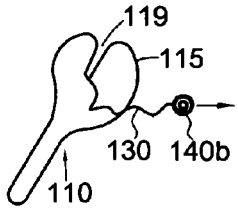
FIG. 15
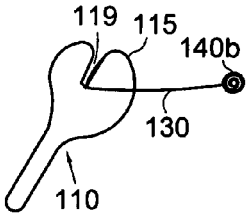
FIG. 16
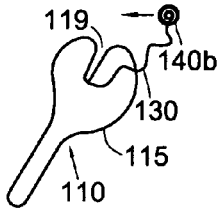
FIG. 17
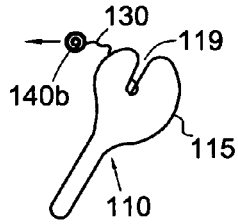
FIG. 18
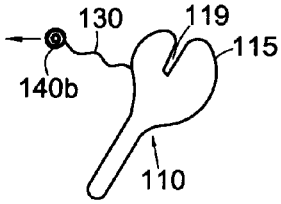
FIG. 19
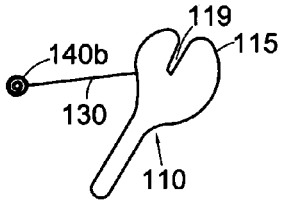
FIG. 20
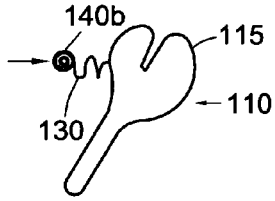
FIG. 21
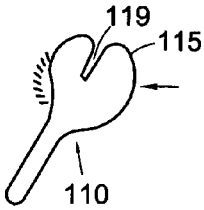
FIG. 22
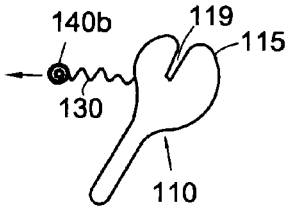
FIG. 23
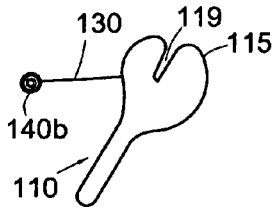
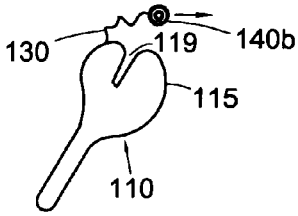
FIG. 24
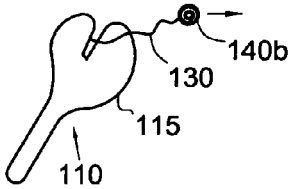
FIG. 25

ASYMMETRIC PADDLEBALL TOY WITH PLAY-DIRECTION SWITCHING SLOT

RELATED APPLICATIONS

The present provisional patent application is based on and claims the priority of provisional patent application Ser. No. 61/745,602 filed Dec. 23, 2012 by the same inventor and having the same title, provisional patent application Ser. No. 61/806,942 filed Jan. 4, 2013 by the same inventor and having the same title, and United Kingdom patent application number 1313130.5 filed Jul. 23, 2013 by the same inventor and having the same title.

FIELD OF THE INVENTION

The present invention relates ball games and toys, and still more particularly to games and toys involving a paddle and a tethered ball, such as paddleball games.

BACKGROUND OF THE INVENTION

Conventional paddleball toys have a paddle with a handle and an impact surface, where the paddle has a roughly ellipsoidal or teardrop-shaped impact surface with a mirror symmetry about its longitudinal axis, and an elastic string tethering a ball, which is secured at or near the center of the impact surface. Such paddleball toys date back decades but the genre has experienced little innovation.

It is an object of the present invention to provide a paddleball toy with new modes of operation and play.

It is an object of the present invention to provide a paddleball toy which allows a player to switch between forehand and backhand play.

It is another object of the present invention to provide a paddleball toy which facilitates play with the paddle oriented at a non-zero angle to vertical and/or horizontal.

It is another object of the present invention to provide a paddleball toy which facilitates play in a mode where the paddle has a transverse motion on impact with the ball, or where the paddle imparts a spin to the ball.

Furthermore, it is an object of the present invention to provide a paddleball toy which makes it easier for beginners to learn to play.

It is also an object of the present invention to provide a paddleball toy with an adjustable string length, particularly an easy and/or quickly adjustable string length.

SUMMARY OF THE INVENTION

A paddleball toy having a paddle, a bounceable play ball, and an elastic tethering means. The paddle has an impact surface and an elongate handle with a handle longitudinal axis. The paddle has a front side and a back side. The handle connects to the impact surface at a lower end of the impact surface. The impact surface has a direction-switch slot extending from a slot bottom at an interior point of the impact surface to an exterior edge of the impact surface. The elastic tethering means tethers the play ball at a first end of the tethering means to a tether spot on the impact surface adjacent the slot bottom of the direction-switch slot so as to permit the tethering means to pass through the direction-switch slot as the play ball passes the impact surface from front side to back side, or back side to front side.

BRIEF DESCRIPTION OF THE DRAWINGS

FIGS. 12 to 25 show a direction-switching mode of play enabled by the direction-switch slot of the paddle of the present invention;

DETAILED DESCRIPTION OF THE PREFERRED EMBODIMENTS

Figure 1:
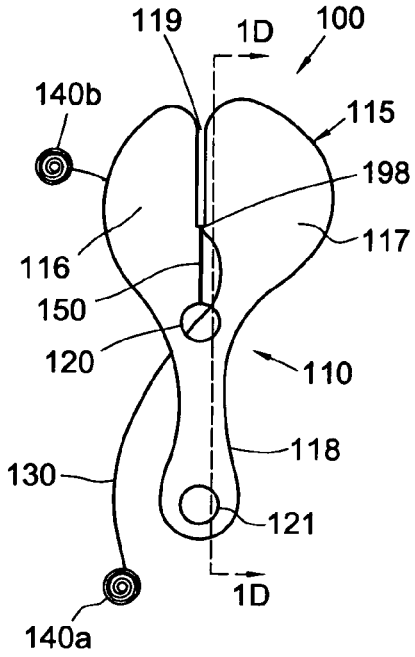
FIG. 1 shows a front view of the paddleball toy of the present invention with neither of the two tethered balls lodged in the ball-retaining apertures in the paddle.
Figure 2:
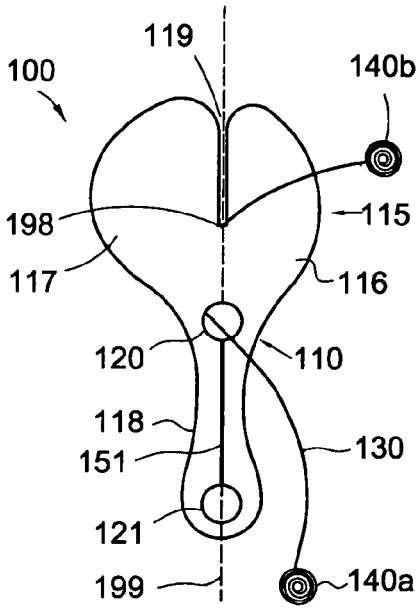
FIG. 2 shows a back view of the paddleball toy shown in FIG. 1.

FIGS. 1 to 6 show a paddleball toy (100) of the present invention. The toy (100) has a paddle (110), an anchor ball (140*a*) and a play ball (140*b*) secured at distal ends of an elastic tether (130), such as an elastic string. (The balls (140*a*) and (140*b*) will be referred to generically or collectively with the reference numeral 140.) Both balls (140) are made of a rubber or rubbery plastic so as to be sufficiently resilient so that it is bounceable in use. The anchor ball (140*a*) is secured to the elastic tether (130) at what is shown as the lower end of the paddle (110) and the play ball (140*b*) is secured to the elastic tether (130) at what is shown as the upper end of the paddle (110). The paddle (110) has an impact surface (115) and a handle (118) having a longitudinal axis (199*a*). The impact surface (115) has a small lobe (116) and a large lobe (117). Between the two lobes (116) and (117) is a direction-switch slot (119) having a longitudinal axis (199*b*) and which extends from the top of the paddle (110) to a slot bottom (198) at an interior point about halfway down the lobes (116) and (117). In the embodiment shown in FIGS. 1 to 6, the longitudinal axis (199*a*) of the handle (118) is coincident with the longitudinal axis (199*b*) of the direction-switch slot (119), and is referenced in the Figures with reference numeral "199". In the embodiment shown in FIG. 9, near the bottom (198) of the direction-switch slot (119) is a pass-through aperture (152) through which the elastic tether (130) passes. The aperture (152) communicates between the front and back faces of the paddle and has a sufficient width to permit the tether (130) to pass through the aperture so that the ball may contact the opposite face to the face to which the tether is secured. In a preferred embodiment, the larger lobe (117) has at least 15% greater surface area than the smaller lobe (116), more preferably at least 25% greater surface area than the smaller lobe (116), more preferably at least 40% greater surface area than the smaller lobe (116), more preferably at least 60% greater surface area than the smaller lobe (116), more preferably at least 80% greater surface area than the smaller lobe (116), and still more preferably at least 100% greater surface area than the smaller lobe (116). Furthermore, the ratio of the width of the larger lobe (117) to the length of the direction-switch slot (119) is in the range of 1.0 to 2.0. The ratio may be at least 1.0, more preferably 1.15, more preferably 1.3, more preferably 1.4, more preferably 1. 5, more preferably 1.65, more preferably 1.8 and even more preferably 2.0. As shown in the cross-sectional view of the paddle (110) of FIG. 7, the thickness of the handle (118) is greater than the thickness of the impact surface (115) to facilitate gripping of the handle (118) during play.

Figure 8:
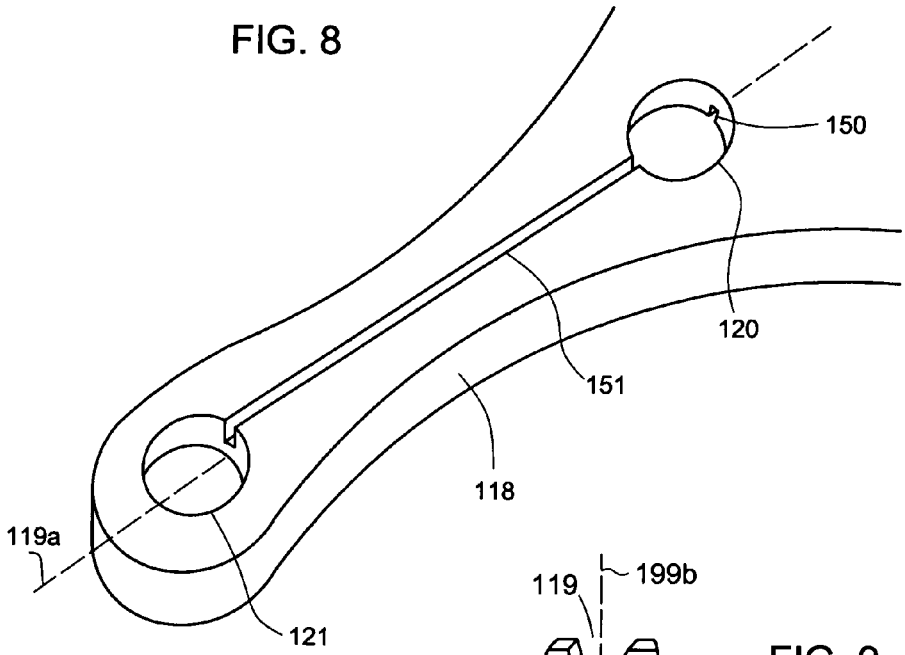
FIG. 8 is a close-up perspective view of the lower tether channel in the handle of the paddleball toy.

The paddle (110) has a lower ball-retaining aperture (121) at the bottom end of the handle (118) and an upper ball-retaining aperture (120) roughly where the handle (118) meets the impact surface (115). Both apertures (120) and (121) are circular and have a diameter slightly less than the diameter of the balls (140) so that the either ball (140) may be removably lodged in either aperture (120), (121). As shown in the close-up perspective view of FIG. 8 and also visible in FIGS. 2, 4 and 6, on the back face of the paddle a lower tether channel (151) extends from the lower ball-retaining aperture (121) to the upper ball-retaining aperture (120). It should be noted that reference to the faces of the paddle (110) as "front" and "back" is arbitrary and used only for convenience of exposition since play can be performed using either side of the paddle (110). The face that would be considered the front for forehand play by a righthanded player would be considered as the back face for backhand play by a lefthanded player, and vice versa.) As shown in the close-up perspective view of FIG. 9 and also visible in FIGS. 1, 3, and 5, on the front face of the paddle (110) an upper tether channel (150) extends from the upper ball-retaining aperture (120) to the bottom of the slot (119). Near the top of the upper tether channel (150) is a pass-through aperture (152) which extends through the paddle (110) and through which the elastic tether (130) passes. The tether channels (150) and (151) and the pass-through aperture (152) have a width and depth somewhat greater than the diameter of the elastic tether (130), yet narrow relative to the diameter of the balls (140) so as not to affect rebounds of the play ball (140*b*) from the paddle (110).

Figure 9:
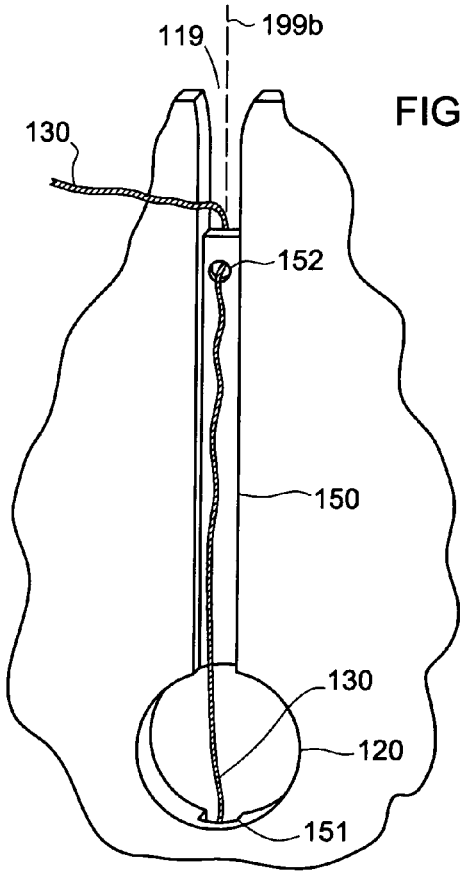
FIG. 9 is a close-up perspective view of an upper tether channel having a pass-through aperture at the top.
Figure 10:
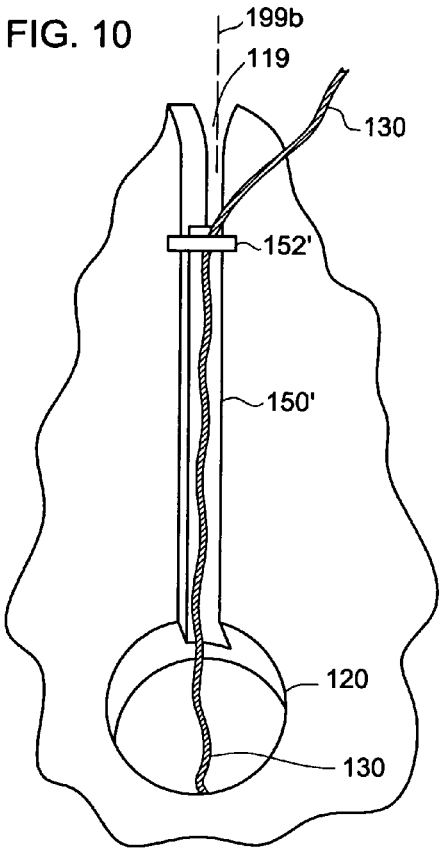
FIG. 10 is a close-up perspective view of an upper tether channel having a crossbar at the top.

In an alternate embodiment of the present invention shown in FIG. 10, upper tether channel (150') has a crossbar (152') across its upper end, and the elastic tether (130) runs up (i.e., within) the channel (150') and under the crossbar (152'). In another alternate embodiment shown in FIG. 3, upper tether channel (150") is a tunnel through the paddle (110) from the upper ball-retaining aperture (121) to the base of the direction-switch slot (119), and the elastic tether (130) runs up (i.e., within) the channel (150'). Tether channels (150), (150') and (150") are straight and have a rectangular cross-section. It should be noted that in FIGS. 8, 9, 10 and 11 the width and/or depth of the tether channels (151), (150), (150') and (150") is shown exaggerated somewhat for visual clarity. Generically, the general area where the elastic tether (130) meets the impact surface (115) will be referred to as the tether spot.

Figure 3:
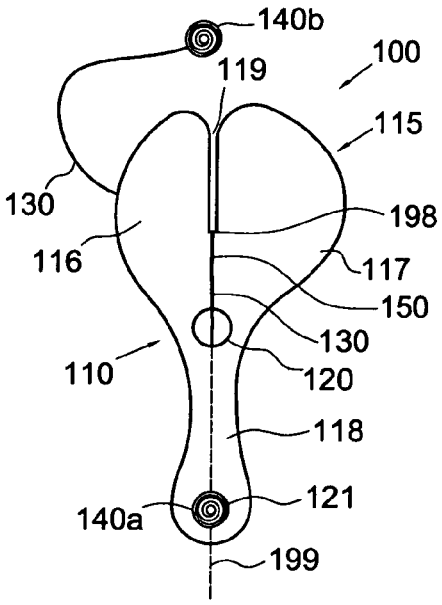
FIG. 3 shows a front view of the paddleball toy of the present invention with the anchor ball lodged in the lower ball-retaining aperture.
Figure 4:
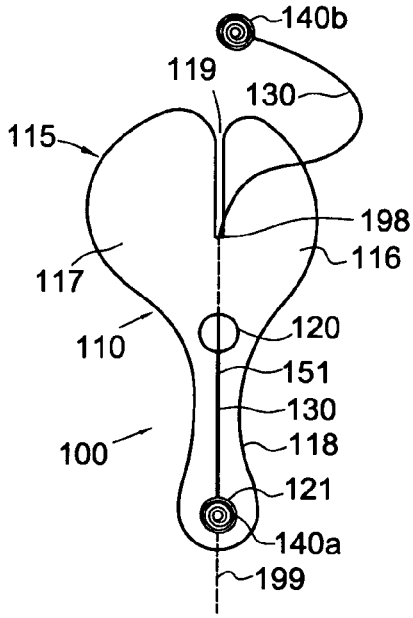
FIG. 4 shows a back view of the paddleball toy as shown in FIG. 3.
Figure 5:
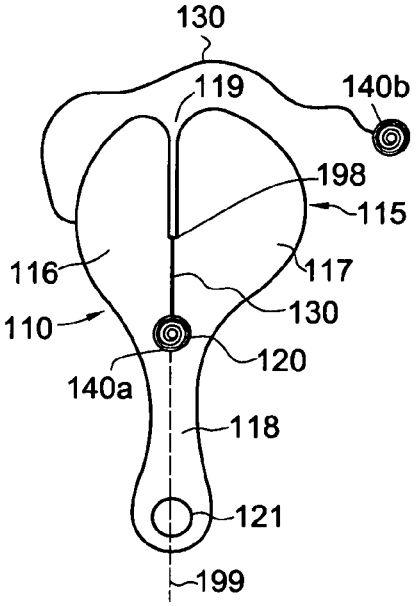
FIG. 5 shows a front view of the paddleball toy of the present invention with the anchor ball lodged in the upper ball-retaining aperture.
Figure 6:
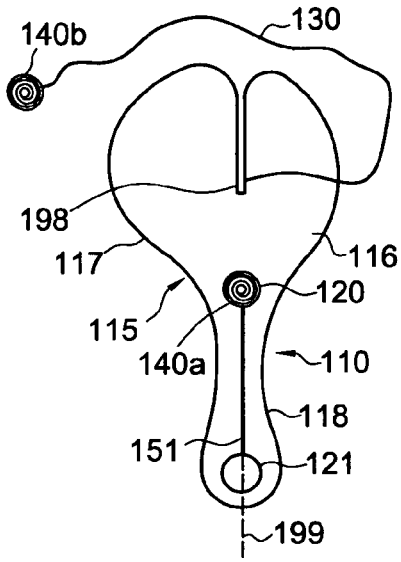
FIG. 6 shows a back view of the paddleball toy as shown in FIG. 5.
Figure 7:
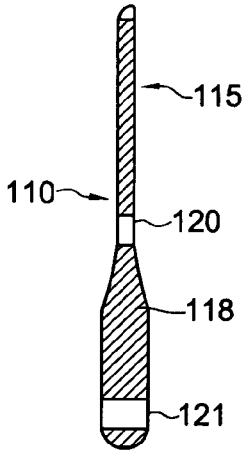
FIG. 7 is a cross-sectional view of the paddle of FIGS. 1 to 6.
Figure 11:
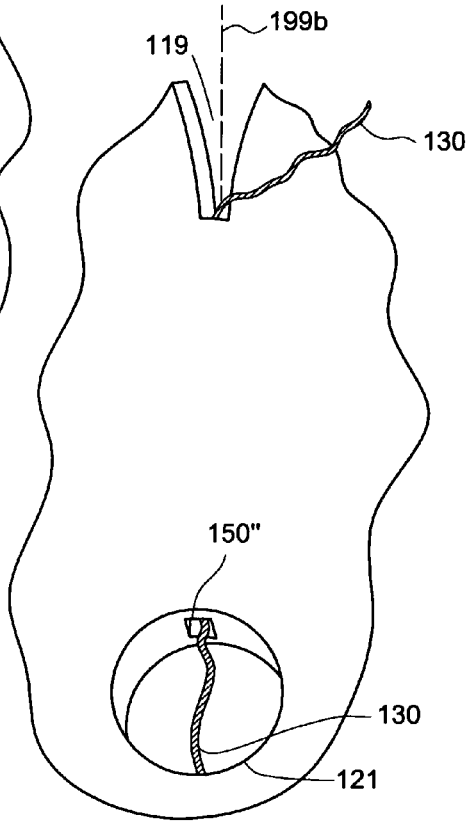
FIG. 11 is a close-up perspective view of an upper tether channel which is a tunnel from the upper ball-retaining aperture to the bottom of the direction-switch slot.

FIGS. 5 and 6 show the paddleball toy (100) with the anchor ball (140*a*) lodged in the lower ball-retaining aperture (121), the play ball (140*b*) free, and the elastic tether (130) running up (i.e., within) the lower tether channel (151), across the upper ball aperture (120), and up (i.e., within) the upper tether channel (150). Although not visible in FIGS. 5 and 6, the elastic tether (130) passes through the pass-through aperture (152) if the embodiment of FIG. 9 is used, or under the crossbar (152') if the embodiment of FIG. 10 is used. The descriptions below also hold if the embodiment of FIG. 11 is used, although in that case the tether channel (150") would not be visible in FIGS. 1, 3 and 5. As will be apparent from the discussion of modes of play facilitated by the direction-switch slot (119) in conjunction with FIGS. 12 to 25, the pass-through aperture (152), crossbar (152') and tunneled channel (150") provide the important benefit that the elastic tether (130) extends from at or near the base of the direction-switch slot (119) regardless of whether the elastic tether (130) extends to the front or back of the paddle (110).) FIGS. 5 and 6 show the paddleball toy (100) with the anchor ball (140*a*) lodged in the upper ball-retaining aperture (120), the play ball (140*b*) free, and the elastic tether (130) running up (i.e., within) the upper tether channel (150). With the anchor ball (140*a*) lodged in the lower ball-retaining aperture (121), as shown in FIGS. 3 and 4, the length of elastic tether (130) provided for motion of the play ball (140*b*) is less than that provided when the anchor ball (140*a*) is lodged in the upper ball-retaining aperture (120), as shown in FIGS. 5 and 6. Therefore, the option to lodge the anchor ball (140*a*) in either the upper or lower ball-retaining aperture (120) or (121) play to be easily adjusted between a long or short length of the elastic tether (130) tethering the play ball (140*b*).

Figure 27:
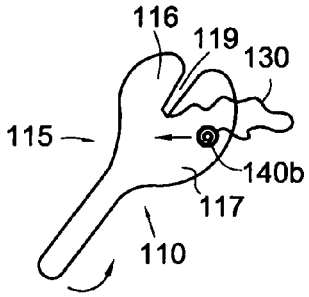

As depicted in FIGS. 11 to 25, the direction-switch slot (119) in the paddle (110) enables forehand play, backhand play, and play which switches between forehand and backhand play. For ease of depiction, details such as the anchor ball (140*a*), the tether channels (150) and (151), the ball-retaining apertures (120) and (121), etc. are not depicted in FIGS. 12 to 25 It should be noted that in the embodiments of FIGS. 9 to 10 and 11 and further alternate embodiments not explicitly depicted herein but considered to be within the scope of the present invention, the pass-through aperture (152), the cross-bar (152') and the end of the tunneled channel (150") that opens into the direction-switch slot (119), respectively, function to ensure that the elastic tether (130) exits the channel (150), (150'), (150") at the base of the direction-switch slot (119) regardless of whether the elastic tether (130) extends to the front or back of the paddle (110). FIG. 12 depicts forehand play where the play ball (140*b*) is approaching the paddle (110). In FIG. 13, the play ball (140*b*) impacts the impact surface (115) of the paddle (110) near the base of the direction-switch slot (119) as the paddle (110) is moved rightwards so as impart additional energy to the play ball (140*b*) upon impact. As a result, the play ball (140*b*) travels away from the paddle (110), as shown in FIG. 14, reaches a standstill with the elastic tether (130) in an elongated state, as shown in FIG. 15, and returns towards the paddle (110), as is shown in FIG. 16. At this point the player (not shown) can position the paddle (110) so that the play ball (140*b*) again impacts the paddle (110), as depicted in FIG. 13, to continue forehand play. Alternatively the player can position the paddle (110) so that the play ball (140*b*) misses the paddle (110), as shown in FIG. 16, and continues on past the paddle (110), as shown in FIGS. 17 and 18. It is important to note that as the play ball (140*b*) continues past the paddle (110), a bottom portion of the elastic tether (130) passes through the direction-switch slot (119), as is shown in FIGS. 16,17 and 18. In FIG. 18 the play ball (140*a*) continues leftwards and, as is shown in FIG. 19, reaches a momentary standstill with the elastic tether (130) extended. The elastic tether (130) pulls the play ball (140*b*) back towards the paddle (110), as shown in FIG. 20, and if the paddle (110) is positioned appropriately the play ball (140*b*) strikes the impact surface (115) of the back side of the paddle (110), as is shown in FIG. 21, to provide a backhand impact. The paddle (110) may be moved leftwards by the player upon impact of the play ball (140*b*) with the paddle (110) to provide additional energy to the play ball (140*b*). Subsequent to the impact depicted in FIG. 21, the play ball (140*b*) travels leftwards, as shown in FIG. 22, until the elastic tether (130) becomes fully extended and the play ball (140*b*) reaches a momentary standstill, as is shown in FIG. 27. The tension applied by the elastic tether (130) then pulls the play ball (140*b*) back rightwards. The paddle (110) may be positioned to provide another impact of the play ball (140*b*) with the back of the paddle (110), as is shown in FIG. 21, to continue backhand play, or the player may position the paddle (110) so that the play ball (140*b*) travels past the paddle (110) and the elastic tether (130) passes through the direction-switch slot (119), as depicted in FIGS. 24 and 25, to return to forehand play as depicted in FIG. 12 through 15. It should be noted that what is described in this paragraph as forehand and backhand play, may also be described as the backhand and forehand play, respectively, if the paddle (110) is held in the other hand and the orientation of the player is reversed.

Figure 26:
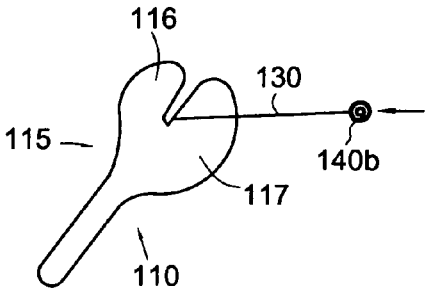
FIGS. 26 to 29 show a perspective view of an off-axis swing mode of play facilitated by the asymmetric paddle of the present invention.
Figure 28:
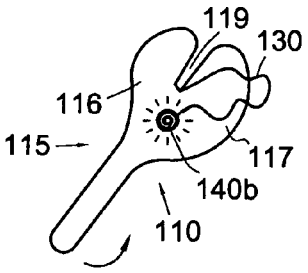
Figure 29:
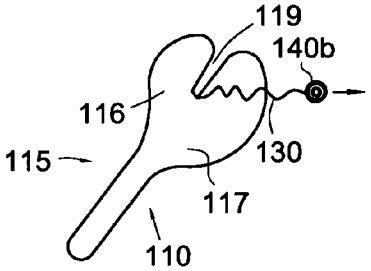
Figure 30:
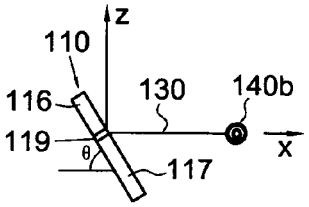
FIGS. 30 to 33 show a schematic cross-sectional view on an x-z axis of the off-axis swing mode of play.
Figure 31:
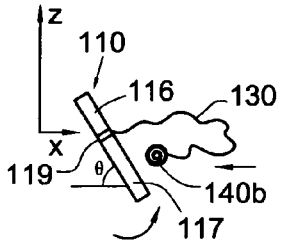
Figure 32:
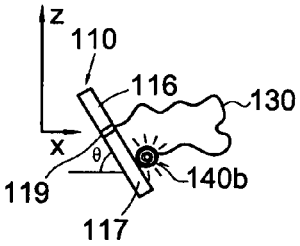
Figure 33:
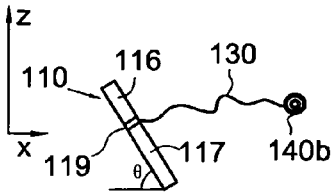

Another mode of play facilitated by the paddle (110) of the present invention is shown in the perspective views of FIGS. 26 to 29 and the schematic cross-sectional views of FIGS. 30 to 33 at corresponding times, i.e., FIGS. 26 and 30 show views at the same moment, FIGS. 27 and 31 show views at the same moment, etc. FIGS. 26 and 30 show the elastic tether (130) in an extended state along the x axis and the play ball (140*b*) at a standstill and, as shown in schematic view of FIG. 30, the impact face (115) of the paddle (110) is at a non-zero angle θ from horizontal. It is important to note that, in contrast, in conventional play with conventional paddleball paddles, the impact surface of the paddle must be held very close to vertical or horizontal.) The tension of the elastic tether (130) pulls the play ball (140*b*) back towards the paddle (110), as is shown in FIGS. 27 and 31. In the off-axis swing mode of play facilitated by the asymmetric paddle (110) of the present invention, the paddle (110) is not swung directly opposite the direction of travel of the play ball (140*b*), i.e., along the x axis, but rather the paddle (110) is swung rightwards as well as upwards, i.e., transversely, as indicated by the arced motion arrows in FIGS. 27 and 31. Due to this upwards and rightwards swing of the paddle (110) and to gravity pulling the play ball (140*b*) downwards as it travels leftwards, as shown in FIGS. 28 and 32, the paddle (110) moves rightwards and upwards away from the origin and the play ball (140*b*) strikes the impact face (115) on the lobe (117) located on the downward side of the direction-switch slot (119). The larger lobe (117) is located to the downwards side of the direction-switch slot (119) to provide additional impact area, thereby facilitating this mode of play. Subsequent to impact, the play ball (140*b*) travels rightwards, as shown in FIGS. 29 and 33, and further rounds of off-axis (i.e., transverse) swing play, as shown in FIGS. 26 o 29 and FIGS. 30 to 33, can be performed.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. For instance: the lobes may be symmetric, i.e., of equal size and/or shape; the paddle may not include ball-retaining apertures; the length of the string may not be adjustable; the toy may have only one ball; the slot may not be oriented along the axis of the handle; the slot may be longer or shorter than depicted and described; the anchor ball may or may not be bounceable; the anchor ball may have an equatorial groove around which the elastic tether may be wrapped, thereby providing another means of adjusting the length of the string; etc. Accordingly, it is intended that the scope of the invention be determined not by the embodiments illustrated or the physical analyses motivating the illustrated embodiments, but rather by the claims and their legal equivalents.

What is claimed is:

1. A paddleball toy comprising:

a paddle having an impact surface and an elongate handle with a handle longitudinal axis, said paddle having a front side and a back side, said handle connecting to said impact surface at a lower end of said impact surface, said impact surface having a direction-switch slot extending from a slot bottom at an interior point of said impact surface to an exterior edge of said impact surface;

a bounceable play ball; and an elastic tethering means tethering said play ball at a first end of said tethering means to a tether spot on said impact surface adjacent said slot bottom of said direction-switch slot so as to permit said tethering means to pass through said direction-switch slot as said play ball passes said impact surface from said front side to said back side, and so as to permit said tethering means to pass through said direction-switch slot as said play ball passes said impact surface from said back side to said front side; and wherein said impact surface has a smaller lobe to a first side of said direction-switch slot and a larger lobe to a second side of said direction-switch slot.

2. The paddleball toy of claim 1 wherein said direction-switch slot has a slot longitudinal axis coincident with said handle longitudinal axis.

3. The paddleball toy of claim 2 wherein said tether point is between said slot bottom and said handle.

4. The paddleball toy of claim 1 wherein said larger lobe has at least 15% greater surface area than said smaller lobe.

5. The paddleball toy of claim 1 wherein said larger lobe has at least 80% greater surface area than said smaller lobe.

6. The paddleball toy of claim 1 wherein a ratio of a width of said larger lobe to a length of said direction-switch slot is at least 1.15.

7. The paddleball toy of claim 1 wherein said tethering means is secured to said impact surface at said tether point.

8. The paddleball toy of claim 1 wherein said tether point is between said slot bottom and said handle.

9. A paddleball toy comprising:

a paddle having an impact surface and an elongate handle with a handle longitudinal axis, said paddle having a front side and a back side, said handle connecting to said impact surface at a lower end of said impact surface, said impact surface having a direction-switch slot extending from a slot bottom at an interior point of said impact surface to an exterior edge of said impact surface;

a bounceable play ball;

an elastic tethering means tethering said play ball at a first end of said tethering means to a tether spot on said impact surface adjacent said slot bottom of said direction-switch slot so as to permit said tethering means to pass through said direction-switch slot as said play ball passes said impact surface from said front side to said back side, and so as to permit said tethering means to pass through said direction-switch slot as said play ball passes said impact surface from said back side to said front side; and an anchor ball at a second end of said elastic tethering means, a lower ball-retaining aperture located on said handle and having a lower aperture width less than an anchor ball diameter of said anchor ball so said anchor ball may be removeably lodged therein, and an upper ball-retaining aperture located above said lower ball-retaining aperture and having an upper aperture width less than said anchor ball diameter of said anchor ball so said anchor ball may be removeably lodged therein, so said anchor ball may be lodged in said upper ball-retaining aperture to provide a greater portion of said tethering means for play with said play ball, and said anchor ball may be removably lodged in said lower ball-retaining aperture to provide a shorter portion of said tethering means for play with said play ball.

10. The paddleball toy of claim 9 wherein said lower ball-retaining aperture is located near a bottom end of said handle, and said upper ball-retaining aperture is located near where said handle meets said impact surface.

11. The paddleball toy of claim 10 wherein said tether spot is an aperture communicating with both sides of the impact surface, said tethering means passing through said aperture from said front side to said back side of said impact surface, and said tethering means passing through said upper ball-retaining aperture from said back side to said front side of said impact surface.

12. The paddleball toy of claim 10 wherein said handle includes a lower tether channel between said upper ball-retaining aperture and said lower ball-retaining aperture, said lower tether channel having a lower channel width and a lower channel depth, and said tethering means having a tether cross-sectional diameter, said tether cross-sectional diameter being less than said lower channel width and said lower channel depth so said tethering means may be located within said lower tether channel when said anchor ball is removeably lodged in said lower ball-retaining aperture.

13. The paddleball toy of claim 10 further including an upper tether channel between said upper ball-retaining aperture and said tether spot, said upper tether channel having an upper channel width and an upper channel depth, and said tethering means having a tether cross-sectional diameter, said tether cross-sectional diameter being less than said upper channel width and said upper channel depth so said tethering means may be located within said upper tether channel.

14. The paddleball toy of claim 9 wherein said tether spot is an aperture communicating with both sides of the impact surface, said tethering means passing through said aperture from said front side to said back side of said impact surface, and said tethering means passing through said upper ball-retaining aperture from said back side to said front side of said impact surface.

15. The paddleball toy of claim 14 wherein said handle includes a lower tether channel between said upper ball-retaining aperture and said lower ball-retaining aperture, said lower tether channel having a lower channel width and a lower channel depth, and said tethering means having a tether cross-sectional diameter, said tether cross-sectional diameter being less than said lower channel width and said lower channel depth so said tethering means may be located within said lower tether channel when said anchor ball is removeably lodged in said lower ball-retaining aperture.

16. The paddleball toy of claim 14 further including an upper tether channel between said upper ball-retaining aperture and said tether spot, said upper tether channel having an upper channel width and an upper channel depth, and said tethering means having a tether cross-sectional diameter, said tether cross-sectional diameter being less than said upper channel width and said upper channel depth so said tethering means may be located within said upper tether channel.

17. The paddleball toy of claim 9 wherein said handle includes a lower tether channel between said upper ball-retaining aperture and said lower ball-retaining aperture, said lower tether channel having a lower channel width and a lower channel depth, and said tethering means having a tether cross-sectional diameter, said tether cross-sectional diameter being less than said lower channel width and said lower channel depth so said tethering means may be located within said lower tether channel when said anchor ball is removeably lodged in said lower ball-retaining aperture.

18. The paddleball toy of claim 9 further including an upper tether channel between said upper ball-retaining aperture and said tether spot, said upper tether channel having an upper channel width and an upper channel depth, and said tethering means having a tether cross-sectional diameter, said tether cross-sectional diameter being less than said upper channel width and said upper channel depth so said tethering means may be located within said upper tether channel.

19. The paddleball toy of claim 18 wherein said upper tether channel comprises an aperture within the impact surface.

20. The paddleball toy of claim 18 wherein said upper tether channel runs along and is open to said back side of said impact surface, and said upper channel width is substantially less than a play ball diameter of said play ball so that rebounds of said play ball on said back side of said impact surface which fall upon said upper tether channel are not substantially influenced by said upper tether channel.

* * * * *